US005996524A

United States Patent [19]

Johnson

[11] Patent Number: 5,996,524

[45] Date of Patent: Dec. 7, 1999

[54] BOAT ANCHOR DAVIT

[76] Inventor: Robert K. Johnson, 10733 Spring St., Largo, Fla. 33774

[21] Appl. No.: 09/137,018

[22] Filed: Aug. 20, 1998

[51] Int. Cl.[6] ..... B63B 21/22

[52] U.S. Cl. ..... 114/210

[58] Field of Search ..... 114/210, 364, 114/293; D8/356

[56] References Cited

U.S. PATENT DOCUMENTS

| | | | |
|---|---|---|---|
| D. 259,240 | 5/1981 | Myron | D8/356 |
| D. 259,329 | 5/1981 | Barbour | D8/356 |
| D. 323,483 | 1/1992 | Patten | D12/317 |
| 1,636,944 | 7/1927 | Schauman . | |
| 1,739,359 | 12/1929 | Hausenfluck . | |
| 1,749,193 | 3/1930 | Schauman et al. . | |
| 1,767,568 | 6/1930 | Wills . | |
| 2,608,174 | 8/1952 | Sponsenburg | 114/199 |
| 2,837,050 | 6/1958 | Frank | 114/210 |
| 2,899,924 | 8/1959 | Good | 114/210 |
| 3,071,097 | 1/1963 | Dowrelio | 114/210 |
| 3,082,730 | 3/1963 | Good | 114/210 |
| 4,248,171 | 2/1981 | Barbour | 114/210 |
| 4,362,119 | 12/1982 | Thimander | 114/210 |
| 4,556,007 | 12/1985 | Awalt, Jr. | 114/210 |

*Primary Examiner*—Stephen Avila

*Attorney, Agent, or Firm*—Dennis G. LaPointe; Joseph C. Mason, Jr.; Mason & Associates, P.A.

[57] ABSTRACT

An anchor davit comprising an elongated U-shaped frame for receiving a main shank of an anchor; a roller at the outboard end of the frame for guiding the anchor line as it is lowered or raised; means at the outboard end of the U-shaped frame for providing chafe protection of an anchor line when the anchor is deployed and for providing captivity of the anchor when the anchor is being raised and secured; and means at a rear portion of the flat bottom portion juxtaposed the rear of the U-shaped frame for securing the U-shaped frame to a bow, a deck, a gunnel or another structural member of a boat. The means at the outboard end of the U-shaped frame for providing chafe protection of the anchor line and for providing captivity of the anchor comprises a smooth round rod. The round rod forms an arcuate shape above and between the sides of the U-shaped frame, extends downwardly along respective edges of the sides and further extends a predetermined distance below said sides and forms an arcuate shape in a direction toward the rear of the U-shaped frame, ending at a respective opposite edge of an extended vertical portion of the sides which extends below the flat bottom portion. The rod is welded to the edges of the sides with which the rod is in contact and the arcuate shape formed above and between the sides of the U-shaped frame serves as a bail for captivating the anchor line or the shank of the anchor.

7 Claims, 3 Drawing Sheets

BOAT ANCHOR DAVIT

BACKGROUND OF THE INVENTION

1. Field of the Invention

The invention relates to apparatus for raising and lowering, and for storing or securing of anchors.

2. Description of Related Art

Boat anchor davits or anchor handling and securing assemblies are known in the art. These devices are typically over-the-gunnel devices and usually fall into two classes: bow rollers and boom or pulpit type. The boom or pulpit type anchor device ordinarily comprises a roller or fairlead permanently mounted on a pulpit, bow sprit or boom out over the water. Such a mount provides clearance from the side and gunwale as the anchor is retrieved and stored.

However, anchors come in many sizes, shapes and materials. When used with prior art davits, the exposed edges of the davit frames can cause chafing against the rode or anchor line when the anchor is lowered. As a boat moves about due to current and wind changes and rolls and pitches due to wave action, the anchor line or rode will rub or chafe against an edge of the davit thereby compromising the integrity of the line and potentially placing the boat in jeopardy. When an anchor is being raised, prior art davits are designed such that chafing, or damage to a surface of the boat, or injury to a person, can occur should the combination of roll and pitch of the boat as the anchor line is being raised cause the anchor to jump the roller of a davit. Chafing can also occur when the anchor line is deployed at large angles relative to the davit axis or boat centerline.

Known related art includes an anchor handling and securing assembly as depicted in U.S. Pat. No. 4,248,171 to Barbour. This device depicts a "Bruce" anchor with a roller assembly or davit; however, chafing of the anchor line and captivity of the anchor is not provided. Other prior art includes U.S. Pat. Nos. 2,899,924 and 3,082,730 to Good wherein both patents depict edges which can cause chafing of the anchor line. The '924 patent does include a bail 22 which can provide captivity features. Although the '730 patent does include a bail 40, it is rotatable and the anchor line could still jump the roller thus compromising the captivity feature provided by bail 40. Other known related anchor davits include U.S. Pat. No. 4,362,119 to Thimander, U.S. Pat. No. 2,608,174 to Sponenburg, U.S. Pat. No. 1,767,568 to Wills, U.S. Pat. No. Des. 323,483 to Patten, U.S. Pat. No. 1,739,359 to Hausenfluck, U.S. Pat. No. 1,636,944 to Schauman, U.S. Pat. No. 1,749,193 to Schauman et al., U.S. Pat. No. Des. 259,240 to Myron, U.S. Pat. No. 2,837,050 to Frank, and U.S. Pat. No. 4,556,007 to Awalt, Jr.

None of the devices in the above references solve the problem of providing both 100 percent chafe protection and total captivity of the anchor while being raised. A further object of the present invention is to provide a device to which an anchor can be secured after being raised and cannot thereafter jump the roller assembly and cause damage to the hull, deck, bow or gunnel or injury to a person standing nearby.

SUMMARY OF THE INVENTION

The present invention is an assembly or anchor davit for raising and lowering an anchor, for use as a guide for the anchor line or rode when the anchor is lowered, and for securing an anchor when the vessel is underway.

The invention is adapted such that 100 percent chafing protection is provided to protect the anchor line when the anchor is in use regardless of the angle of the anchor line deployment relative to the vessel position, or is being lowered or raised, or to protect the anchor itself when the anchor has been raised and secured. The present invention is also designed to ensure that there are no crevices or corner for which the anchor line can be snagged or chafed.

The principal object of the invention is to provide a device or anchor davit comprising an elongated U-shaped frame for receiving a main shank of an anchor; a roller at the outboard end of the frame for guiding the anchor line as it is lowered or raised; means at the outboard end of the U-shaped frame for providing chafe protection of an anchor line when the anchor is deployed and for providing captivity of the anchor when the anchor is being raised and secured; and means at a rear portion of the flat bottom portion juxtaposed the rear of the U-shaped frame for securing the U-shaped frame to a bow, a deck, a gunnel or another structural member of a boat.

The means at the outboard end of the U-shaped frame for providing chafe protection of the anchor line and for providing captivity of the anchor comprises a smooth round rod. The round rod forms an arcuate shape above and between the sides of the U-shaped frame, extends downwardly along respective edges of the sides and further extends a predetermined distance below said sides and forms an arcuate shape in a direction toward the rear of the U-shaped frame, ending at a respective opposite edge of an extended vertical portion of the sides which extends below the flat bottom portion.

The round rod is welded to the edges of the sides with which the rod is in contact and the arcuate shape formed above and between the sides of the U-shaped frame serves as a bail for captivating the anchor line or the shank of the anchor.

The round rod and U-shaped frame are preferably made from a non-magnetic Class 300 stainless steel material or a casting and the roller is typically made from a hard rubber material.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
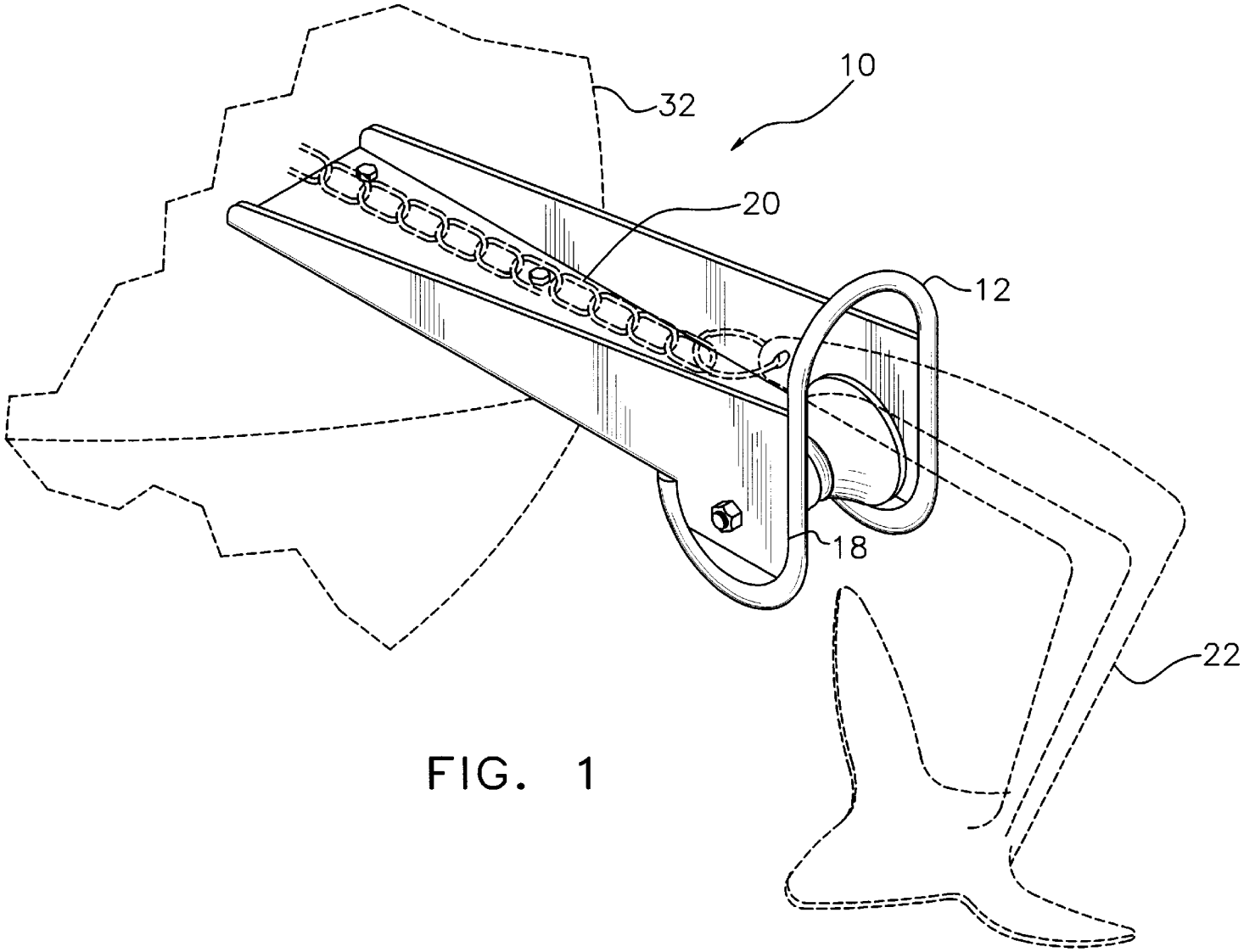
FIG. 1 is a perspective view of the anchor davit extending from a bow of a boat with a "Bruce" anchor connected to an anchor line.
Figure 2:
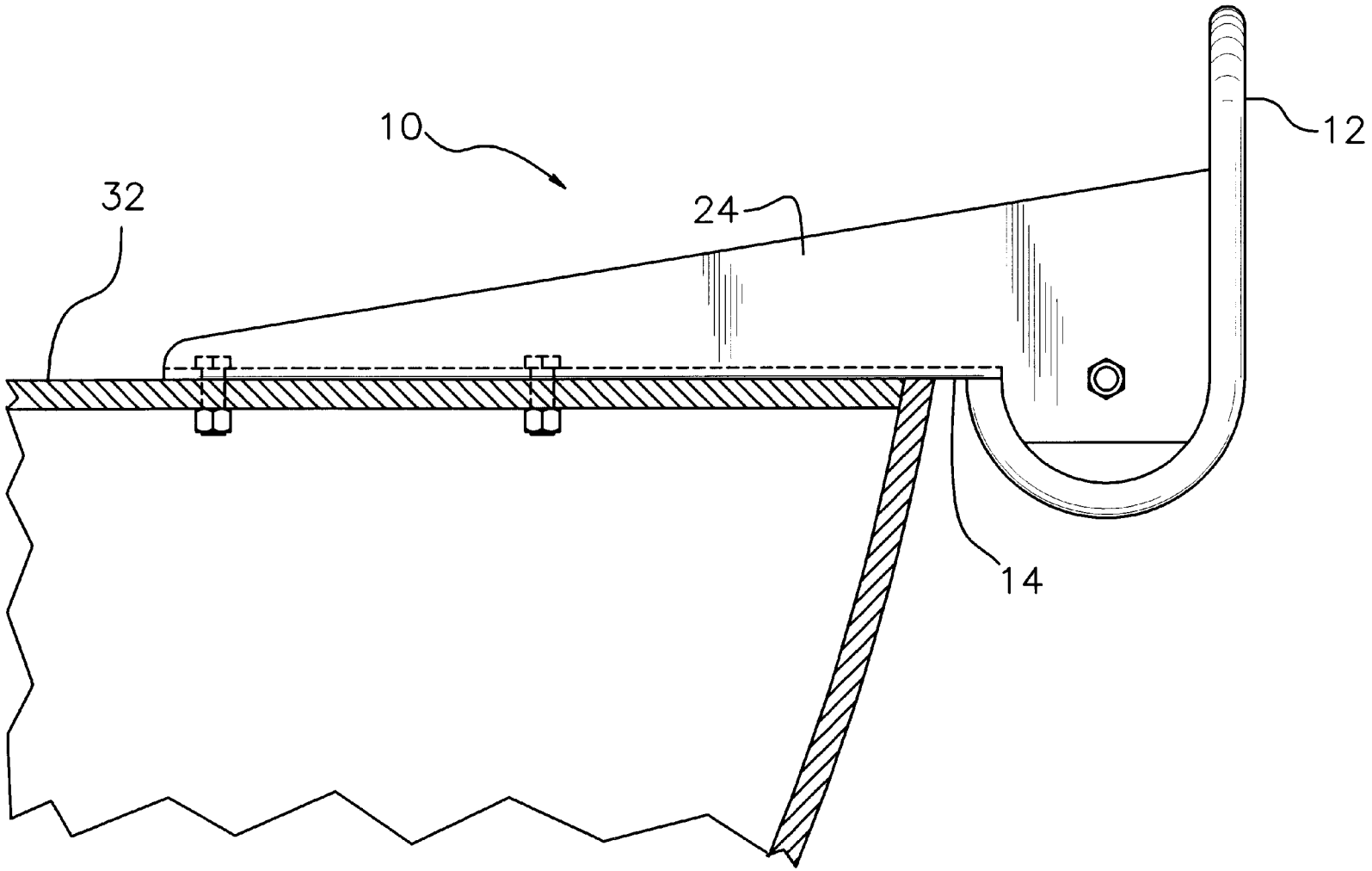
FIG. 2 is a side view of the present invention attached to a structural member of a boat.
Figure 3:
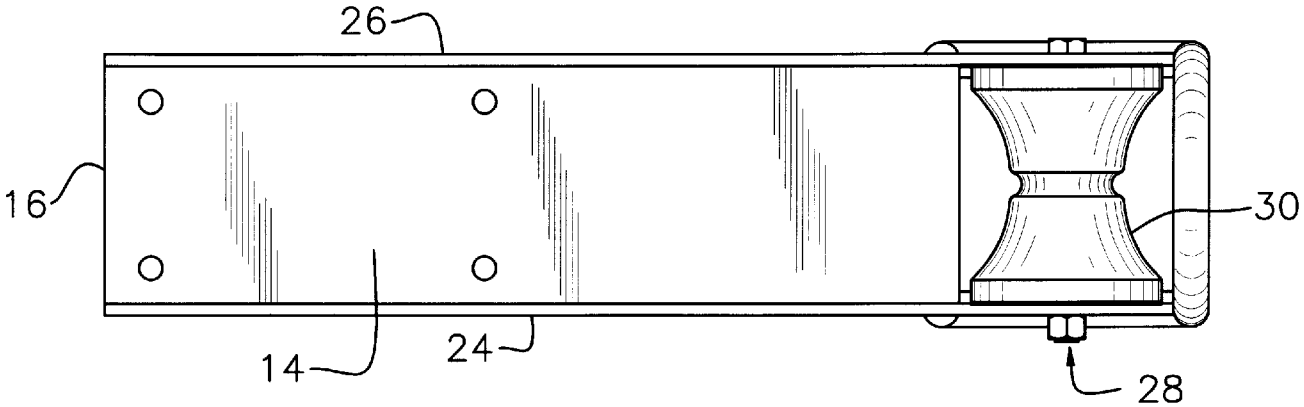
FIG. 3 is a plan view of the present invention.
Figure 4:
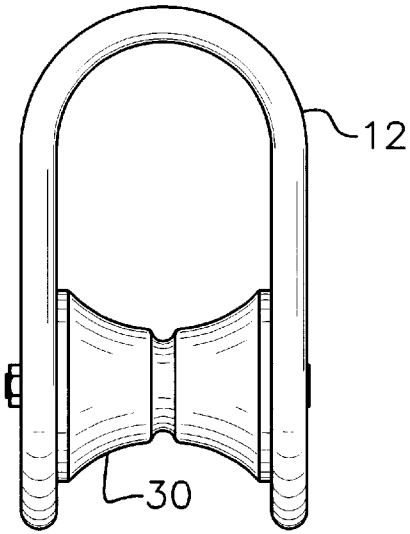
FIG. 4 is an end view of the present invention looking from the outboard end.

Referring now to the drawings, in particular FIGS. 1–4, the invention which is an anchor davit depicted generally as 10, comprises an elongated U-shaped frame having a first end or rear 16, a second end or outboard end 18 which extends over the edge of the structural member 32 of a boat on which the davit is attached, a first side 24 and a second side 26 extending from the first end 16 to the second end 18, and an integral flat bottom portion 14, the sides 24,26 being at a spaced apart relationship for receiving a main shank of an anchor 22.

The integral flat bottom portion 14 is typically shorter in length than the first and second sides 24,26 and extends from the first end 16 to a predetermined distance from the second end 18. A portion of the first and second sides 24,26 of the elongated U-shaped frame which extends beyond the flat bottom portion 14 to the second end 18 further includes an extended vertical portion which extends a predetermined distance below the flat bottom portion 14.

The present invention further includes a roller 30 for guiding the anchor line 20 as it is lowered or raised, including attachment means 28 for mounting and allowing the roller 30 to turn freely between the first and second sides 24,26 juxtaposed the second end 18 of the U-shaped frame. The centerline of the roller 30 is proximately aligned with the flat bottom portion 14.

The principal object of the present invention is to provide means 12 at the second end 18 of the U-shaped frame for providing chafe protection of an anchor line 20 when the anchor 22 is deployed and for providing captivity of the anchor 22 when the anchor 22 is being raised and secured.

The present invention further includes means at a rear portion of the flat bottom portion 14 juxtaposed the first end 16 of the U-shaped frame for securing the U-shaped frame to a bow, a deck, a gunnel or another structural member 32 of a boat. Although the davit may be clamped to a structural member 32 using the flat top surface of bottom portion 14 as a means for securing the davit, the preferred method is to drill holes in the bottom portion 14 to correspond with appropriate structural members 32 on a boat deck, bow, or gunnel so that appropriately sized bolts can be us ed to secure the anchor davit.

The means 12 at the second end 18 of the U-shaped frame for providing chafe protection of the anchor line or rode 20 when the anchor 22 is deployed and for providing captivity of the anchor 22 when the anchor 22 is being raised and secured comprises a round rod having a generally smooth outer surface. The round rod forms an arcuate shape at a predetermined distance above and between the first and second sides 24,26 of the U-shaped frame, extends downwardly along respective edges of the first and second sides 24,26 including the extended vertical portion which extends a predetermined distance below the flat bottom portion 14, and further extends a predetermined distance below said first and second sides 24,26 and forms an arcuate shape in a direction toward the first end 16 of the U-shaped frame and ends at a respective opposite edge of the extended vertical portion of the first and second sides 24,26 which extends below the flat bottom portion 14. The rod is generally fillet welded to the edges of the first and second sides 24,26 with which the rod is in contact.

The arcuate shape at a predetermined distance above and between the first and second sides 24,26 of the U-shaped frame serves as a bail for captivating the anchor line or rode 20 when the anchor 22 is deployed and for captivating the shank of the anchor 22 when the anchor 22 is raised thereby restraining the anchor 22 against vertical movement and against rocking movement.

The roller 30 is preferably made from a hard rubber material. The U-shaped frame and the rod are preferably made from a non-magnetic corrosion resistant material such as a Class 300 stainless steel flat plate and solid round bar stock. Stainless steel material is preferred for the frame and rod not only for its non-corrosive properties but also for its appearance properties as this material can be highly polished. Although stainless steel material is preferred, other non-corrosive materials may be used such as aluminum, nickle-copper-aluminum (K-Monel), bronze or nickle-copper (Monel) castings; however, these materials are much softer than stainless steel and less durable. Zinc or galvanized coated steel may also be used but such materials lack the appearance characteristic generally desired by yacht or other boat owners.

As seen from the foregoing description, the present invention satisfies a long felt need to provide a device which will provide for essentially 100 percent chafe protection of the anchor line or rode while at the same time, provide for captivity of the anchor line or rode while the line is deployed and captivity for the anchor shank when the anchor is raised.

The invention is clearly new and useful as the prior does not provide for essentially 100 percent chafe protection, nor that the prior art teach a device which provides for the combination of captivity and chafe protection by the use of one feature, that is, the round rod attached to the outboard end of the frame. Moreover, it wasnot obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An anchor davit comprising:

an elongated U-shaped frame having a first end, a second end, a first side and a second side extending from the first end to the second end, and an integral flat bottom portion, the sides being at a spaced apart relationship for receiving a main shank of an anchor;

the integral flat bottom portion being shorter in length than the first and second sides and extending from the first end to a predetermined distance from the second end;

a portion of the first and second sides of the elongated U-shaped frame which extends beyond the flat bottom portion to the second end further includes an extended vertical portion which extends a predetermined distance below the flat bottom portion;

a roller for guiding the anchor line as it is lowered or raised, including attachment means for mounting and allowing the roller to turn freely between the first and second sides juxtaposed the second end of the U-shaped frame, a centerline of the roller being proximately aligned with the flat bottom portion;

means at the second end of the U-shaped frame for providing chafe protection of an anchor line when the anchor is deployed and for providing captivity of the anchor when the anchor is being raised and secured and for restraining said anchor against vertical movement and against rocking movement; and means at a rear portion of the flat bottom portion juxtaposed the first end of the U-shaped frame for securing the U-shaped frame to a bow, a deck, a gunnel or another structural member of a boat.

2. The anchor davit according to claim 1 wherein the means at the second end of the U-shaped frame for providing chafe protection of the anchor line when the anchor is deployed and for providing captivity of the anchor when the anchor is being raised and secured and for restraining said anchor against vertical movement and against rocking movement comprises:

a round rod having a generally smooth outer surface, the round rod forming an arcuate shape at a predetermined distance above and between the first and second sides of the U-shaped frame, extending downwardly along respective edges of the first and second sides including the extended vertical portion which extends a predetermined distance below the flat bottom portion, and further extending a predetermined distance below said first and second sides and forming an arcuate shape in a direction toward the first end of the U-shaped frame and ending at a respective opposite edge of the extended vertical portion of the first and second sides which extends below the flat bottom portion, and the rod further being welded to the edges of the first and second sides with which the rod is in contact, wherein the arcuate shape at a predetermined distance above and between the first and second sides of the U-shaped frame is a bail for captivating the anchor line when the anchor is deployed and for captivating the shank of the anchor when the anchor is raised.

3. The anchor davit according to claim 2, wherein the roller is made from a rubber material.

4. The anchor davit according to claim 2, wherein the U-shaped frame and the rod are made from a corrosion resistant material.

5. An anchor davit comprising:

an elongated U-shaped frame having a first end, a second end, a first side and a second side extending from the first end to the second end, and an integral flat bottom portion, the sides being at a spaced apart relationship for receiving a main shank of an anchor;

the integral flat bottom portion being shorter in length than the first and second sides and extending from the first end to a predetermined distance from the second end;

a portion of the first and second sides of the elongated U-shaped frame which extends beyond the flat bottom portion to the second end further includes an extended vertical portion which extends a predetermined distance below the flat bottom portion;

a roller for guiding the anchor line as it is lowered or raised, including attachment means for mounting and allowing the roller to turn freely between the first and second sides juxtaposed the second end of the U-shaped frame, a centerline of the roller being proximately aligned with the flat bottom portion;

means at the second end of the U-shaped frame for providing chafe protection of an anchor line when the anchor is deployed and for providing captivity of the anchor when the anchor is being raised and secured;

the means for providing chafe protection of the anchor line when the anchor is deployed and for providing captivity of the anchor when the anchor is being raised and secured further including a round rod having a generally smooth outer surface, the round rod forming an arcuate shape at a predetermined distance above and between the first and second sides of the U-shaped frame, extending downwardly along respective edges of the first and second sides including the extended vertical portion which extends a predetermined distance below the flat bottom portion, and further extending a predetermined distance below said first and second sides and forming an arcuate shape in a direction toward the first end of the U-shaped frame and ending at a respective opposite edge of the extended vertical portion of the first and second sides which extends below the flat bottom portion, the rod further being welded to the edges of the first and second sides with which the rod is in contact, wherein the arcuate shape at a predetermined distance above and between the first and second sides of the U-shaped frame is a bail for captivating the anchor line when the anchor is deployed and for captivating the shank of the anchor when the anchor is raised thereby restraining said anchor against vertical movement and against rocking movement; and means at a rear portion of the flat bottom portion juxtaposed the first end of the U-shaped frame for securing the U-shaped frame to a bow, a deck, a gunnel or another structural member of a boat.

6. The anchor davit according to claim 5, wherein the roller is made from a rubber material.

7. The anchor davit according to claim 5, wherein the U-shaped frame and the rod are made from a corrosion resistant material.

* * * * *